US009308727B2

(12) United States Patent
Hirai et al.

(10) Patent No.: US 9,308,727 B2
(45) Date of Patent: Apr. 12, 2016

(54) LIQUID EJECTING HEAD AND LIQUID EJECTING APPARATUS

(71) Applicant: SEIKO EPSON CORPORATION, Tokyo (JP)

(72) Inventors: Eiju Hirai, Minowa-machi (JP); Yuma Fukuzawa, Matsumoto (JP); Chikara Kojima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/613,669

(22) Filed: Feb. 4, 2015

(65) Prior Publication Data

US 2015/0231883 A1 Aug. 20, 2015

(30) Foreign Application Priority Data

Feb. 18, 2014 (JP) ..... 2014-028706
Jun. 25, 2014 (JP) ..... 2014-129986

(51) Int. Cl.
*B41J 2/14* (2006.01)
*B41J 2/16* (2006.01)

(52) U.S. Cl.
CPC ..... *B41J 2/161* (2013.01); *B41J 2/14233* (2013.01); *B41J 2002/14258* (2013.01); *B41J 2002/14266* (2013.01); *B41J 2002/14491* (2013.01); *B41J 2202/11* (2013.01)

(58) Field of Classification Search
CPC ..... B41J 2002/1258; B41J 2002/14266; B41J 2/161
See application file for complete search history.

(56) References Cited

U.S. PATENT DOCUMENTS

2004/0104975 A1* 6/2004 Furuhata ..... 347/68
2011/0148990 A1* 6/2011 Miyazawa et al. ..... 347/68
2014/0240403 A1 8/2014 Miyazawa et al.

FOREIGN PATENT DOCUMENTS

JP 2011-126257 6/2011

* cited by examiner

*Primary Examiner* — Kristal Feggins
*Assistant Examiner* — Kendrick Liu
(74) *Attorney, Agent, or Firm* — Workman Nydegger

(57) ABSTRACT

A liquid ejecting head is provided. A lower electrode layer of the liquid ejecting head is divided into separate lower electrodes corresponding to respective pressure chamber spaces. An upper electrode layer is a continuous electrode. Each of the separate lower electrodes has (i) a wide portion whose width is smaller than the width of a pressure chamber space and (ii) a narrow portion whose width is smaller than the wide portion. The wide portion is positioned in a region that corresponds to the opening of the pressure chamber space and includes the center, when seen in the direction of the length of the pressure chamber space, of the pressure chamber space, and the narrow portion continuously extends from the wide portion to a region that corresponds to outside of the opening of the pressure chamber space in the direction of the length of the pressure chamber space.

8 Claims, 4 Drawing Sheets

LIQUID EJECTING HEAD AND LIQUID EJECTING APPARATUS

CROSS-REFERENCE TO RELATED APPLICATIONS

The present application claims priority to Japanese Patent Application No. 2014-028706 filed on Feb. 18, 2014, and Japanese Patent Application No. 2014-129986, filed on Jun. 25, 2014, which applications are hereby incorporated by reference in their entirety.

BACKGROUND

1. Technical Field

The present invention relates to a liquid ejecting head configured to eject liquid by driving piezoelectric elements and a liquid ejecting apparatus including the liquid ejecting head. In particular, the present invention relates to a liquid ejecting head and a liquid ejecting apparatus which are capable of reducing damage to piezoelectric elements.

2. Related Art

A liquid ejecting apparatus is an apparatus that includes a liquid ejecting head and that is configured to eject various kinds of liquid from the ejecting head. Examples of the liquid ejecting apparatus include image recording apparatuses such as an ink jet printer and an ink jet plotter. Recently, the liquid ejecting apparatus has been also used in various kinds of manufacturing equipment, making use of its advantage of being able to shoot a minute amount of liquid accurately to a target position. For example, the liquid ejecting apparatus has been used in a display producing apparatus for producing color filters for liquid crystal displays and the like, an electrode forming apparatus for forming electrodes for organic EL (electro luminescence) displays and FEDs (field emission displays) and the like, and a chip producing apparatus for producing biochips. A recording head for an image recording apparatus ejects liquid ink, whereas a color material ejecting head for a display producing apparatus ejects solutions of R (red), G (green), and B (blue) color materials. Furthermore, an electrode material ejecting head for an electrode forming apparatus ejects a liquid electrode material, whereas a living organic substance ejecting head for a chip producing apparatus ejects a solution of a living organic substance.

The liquid ejecting head is configured such that: liquid is introduced into pressure chambers; the liquid is subjected to a pressure change in the pressure chambers; and the liquid is ejected through nozzles in communication with the pressure chambers. The pressure chambers are formed in a crystalline substrate, such as that made of silicon, by anisotropic etching with dimensional accuracy. Piezoelectric elements are used to cause a pressure change in the liquid in the pressure chambers. A piezoelectric element may have a variety of configurations, and is constituted by, for example: a lower electrode layer which is positioned closer to a pressure chamber; a piezoelectric layer made from a piezoelectric material such as lead zirconate titanate (PZT); and an upper electrode layer, which are formed on top of each other by a film forming technique. For example, in a liquid ejecting head disclosed in FIG. 2 of JP-A-2011-126257, upper and lower electrodes are such that: a lower electrode layer is divided into separate electrodes corresponding to respective pressure chambers; and on the other hand, an upper electrode layer is a common electrode that is a continuous electrode extending across the pressure chambers. Since this configuration is employed, most of the piezoelectric layer is covered by the upper electrode layer. Therefore, the upper electrode layer also functions as a protection film, and the piezoelectric layer has increased moisture resistance. Furthermore, when seen in a direction intersecting the direction along which the pressure chambers are arranged, (when seen in the direction of the length of a pressure chamber), the layers constituting each piezoelectric element extend to outside the region of an opening of the pressure chamber. The reason therefor is as follows. Since the piezoelectric layer is provided over a wide range (entire surface) of a vibration plate with the lower electrode layer therebetween, the upper electrode layer, which extends to outside the region of the opening of each pressure chamber, can cover a wide area of the piezoelectric layer. In such a configuration, each portion in which the piezoelectric layer is sandwiched between the upper and lower electrodes serves as an active part that undergoes a deformation in response to application of voltage to the electrode layers. It should be noted that, in a configuration in which an upper electrode layer is divided into separate electrodes and a lower electrode layer is a common electrode, a moisture-proof protection film is separately provided to protect the piezoelectric layer from moisture. Therefore, the thickness of each piezoelectric element as a whole increases, and thus the piezoelectric element cannot undergo a displacement as efficiently as the earlier-mentioned configuration.

Meanwhile, in the liquid ejecting head having the earlier-mentioned configuration, the active part extends to outside of the region of the opening of each pressure chamber. Therefore, when a drive voltage is applied to the upper and lower electrode layers, an electric field occurs between the upper and lower electrodes also in a portion of the active part which is outside the region of the top opening of the pressure chamber, and this portion also tries to move. However, under this portion of the active part which is outside the region of the top opening of the pressure chamber, there exists a structure (that is, there exists a closed part of the substrate having pressure chambers, in which there are no pressure chamber openings). Therefore, this portion of the active part is fixed and cannot actually move. This causes a problem in that this portion of the active part experiences a large stress and may become broken or burnt. In addition, as compared to a configuration in which an upper electrode layer is divided into separate electrodes and a lower electrode layer is a common electrode, the piezoelectric elements are allowed a larger displacement. Therefore, stress may concentrate on a boundary between (i) a portion of the active part which corresponds to the region of the top opening of the pressure chamber, that is, a portion that can actually move, and (ii) a portion of the active part which is outside the region of the top opening of the pressure chamber, that is, a portion that cannot actually move. This may cause the piezoelectric elements to crack or even break.

SUMMARY

An advantage of some aspects of the invention is that a liquid ejecting head and a liquid ejecting apparatus which can reduce the occurrence of burn damage and breakage due to cracking of piezoelectric elements are provided.

According to an aspect of the invention, there is provided a liquid ejecting head, including: a pressure-chamber-defining member having a plurality of pressure chamber spaces that are arranged along a first direction, the pressure chamber spaces serving as pressure chambers in communication with nozzles; and a piezoelectric element having a first electrode layer, a piezoelectric layer, and a second electrode layer that are stacked in this order from a flexible plate on one side of the pressure-chamber-defining member and positioned above the pressure chamber spaces. The first electrode layer is divided into separate first electrodes corresponding to the respective pressure chamber spaces, and the second electrode layer is a continuous electrode extending along the first direction across the pressure chamber spaces. Each of the separate first electrodes has a first portion and a second portion. The first portion is narrower than a corresponding one of the pressure chamber spaces when seen in the first direction, and the second portion is narrower than the first portion when seen in the first direction. The first portion is positioned in a region that corresponds to an opening of the corresponding one of the pressure chamber spaces and that includes the center of the opening of the corresponding one of the pressure chamber spaces. The center is the center of the opening of the corresponding one of the pressure chamber spaces when seen in a second direction intersecting the first direction. The second portion continuously extends from the first portion to a region that corresponds to outside of the opening of the corresponding one of the pressure chamber spaces in the second direction.

According to this configuration, the second portion, which extends to the region that corresponds to outside of the opening of the pressure chamber space, is narrower than the first portion positioned in the region that corresponds to the opening of the pressure chamber space. Therefore, the area of an active part outside the opening of the pressure chamber (pressure chamber space) is reduced. That is, it is possible to reduce the area of a part at risk of burn damage from stress when the piezoelectric element is driven. Furthermore, since the area of the active part is reduced, it is also possible to reduce the stress that may occur in this part. As a result, it is possible to reduce burn damage and breakage caused by cracking of the active part outside the top opening of the pressure chamber.

It is preferable that the liquid ejecting head be configured such that: in the region that corresponds to outside of the opening of the corresponding one of the pressure chamber spaces in the second direction, the second portion of each of the separate first electrodes and the piezoelectric layer project outwards, in the second direction, from one of opposite ends in the second direction of the second electrode layer; and the one of the opposite ends of the second electrode layer and a projecting part of the piezoelectric layer, the projecting part overlapping the second portion, are covered with an adhesive layer.

In this configuration, the adhesive is provided for the purpose of protecting the piezoelectric layer projecting out from one of the opposite ends in the second direction of the second electrode layer. In this configuration, the adhesive restricts the movement of the active part outside the top opening of the pressure chamber. Therefore, it is possible to reduce the deformation of the active part and to reduce stress concentration. This reduces the likelihood of burn damage occurring in the active part outside the top opening of the pressure chamber.

Furthermore, since the adhesive also covers and protects the end of the second electrode layer, the likelihood of detachment of the second electrode layer is reduced.

It is preferable that the liquid ejecting head be configured such that the width of the second portion of each of the separate first electrodes, in the region that corresponds to outside of the opening of the corresponding one of the pressure chamber spaces in the second direction, is not less than 20% and not more than 55% of a width of the first portion.

According to this configuration, the width of the second portion is not excessively narrow and therefore a reduction in electric conductivity is prevented and, at the same time, the area of the active part outside the pressure chamber space which is at risk of burn damage is reduced. Furthermore, since the area of the active part is reduced, it is also possible to reduce the stress that may occur in this region. Therefore, it is possible to more significantly reduce burn damage and breakage of the active part outside the top opening of the pressure chamber (that is, it is possible to reduce the likelihood of breakage of the pressure-chamber-defining member).

It is preferable that the liquid ejecting head be configured such that: the piezoelectric layer has holes in regions between the pressure chamber spaces adjacent to each other along the first direction; and a boundary portion of each of the separate first electrodes, the boundary portion being a portion between the first portion and the second portion, is in a position displaced from (i) one of opposite ends in the second direction of a corresponding one of the holes in the piezoelectric layer toward (ii) the center of the opening of the corresponding one of the pressure chamber spaces.

Stress is likely to concentrate at a boundary between a region where there is a hole in the piezoelectric layer and a region where there is no hole in the piezoelectric layer (in particular, at one of the opposite ends in the second direction of the hole of the piezoelectric layer). According to the above-described configuration, the boundary portion between the first portion and the second portion is in a position displaced from this boundary toward the center of the opening of the pressure chamber space. This makes it possible to reduce the stress at the boundary and thus possible to reduce stress concentration.

It is preferable that the liquid ejecting head further include a metallic layer provided on the second electrode layer so as to cover a region extending from (i) a position corresponding to one of opposite end portions in the second direction of the opening of the corresponding one of the pressure chamber spaces to (ii) a position short of the one of the opposite ends in the second direction of the second electrode layer. It is preferable that the liquid ejecting head be configured such that the boundary portion between the first portion and the second portion is in a position displaced from (i) one of opposite ends in the second direction, which is closer to the one of the opposite end portions of the opening of the corresponding one of the pressure chamber spaces, of the metallic layer toward (ii) the center of the opening of the corresponding one of the pressure chamber spaces.

According to this configuration in which the metallic layer is provided, it is possible to restrict the movement of this region. In addition, since the boundary portion between the first portion and the second portion is in a position displaced from the end of the metallic layer toward the center of the top opening of the pressure chamber space, it is possible to more significantly suppress the boundary portion from markedly deforming and thus possible to further reduce stress concentration.

According to another aspect of the invention, there is provided a liquid ejecting apparatus including any of the above-described liquid ejecting heads.

According to this configuration, the piezoelectric elements of the liquid ejecting head are less prone to burn damage and less likely to decrease in electric conductivity. This improves the reliability of the apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

The following description discusses embodiments of the present invention with reference to the accompanying drawings. It should be noted that, although a variety of limitations are made as suitable embodiments of the invention in the following description, the scope of the invention is not intended to be limited to such aspects unless otherwise so specified in the following description. Furthermore, in the following description, an ink jet printer (hereinafter referred to as a printer) including an ink jet recording head (hereinafter referred to as a recording head), which is a kind of liquid ejecting head, is described as one example of a liquid ejecting apparatus of the invention.

Figure 1:
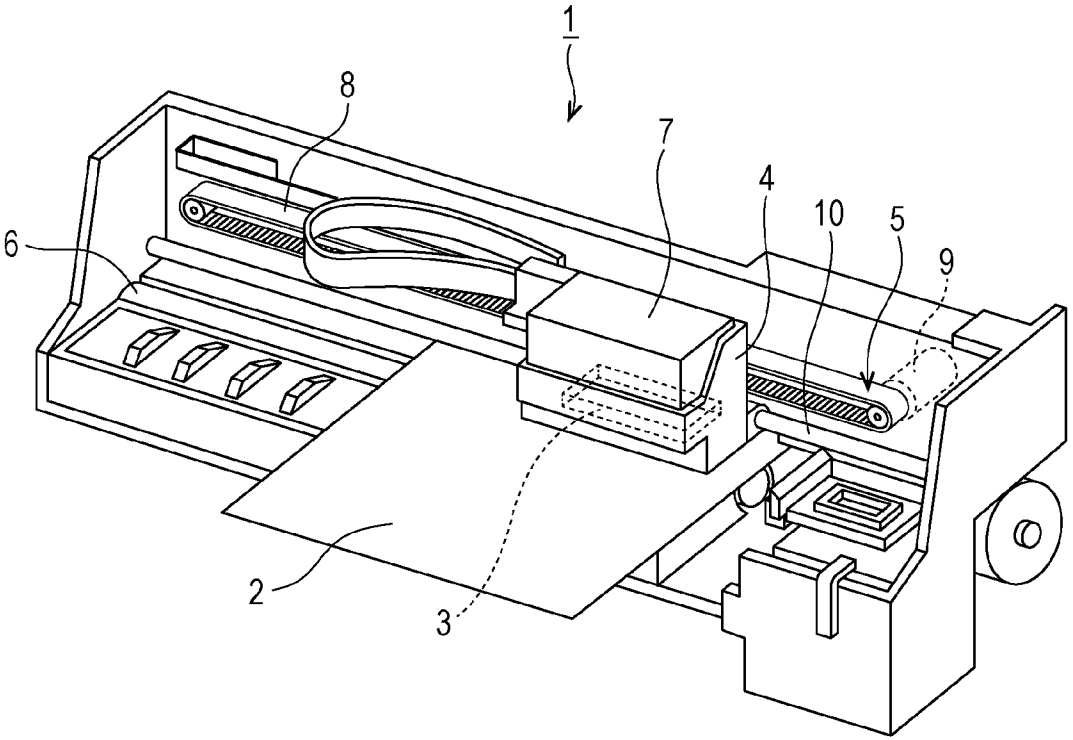
FIG. 1 is a perspective view illustrating an inner structure of a printer.

A configuration of a printer 1 is described with reference to FIG. 1. The printer 1 is an apparatus for recording images or the like on the surface of a recording medium 2 (a kind of target toward which ink is shot) such as a sheet of recording paper by ejecting liquid ink to the surface of the paper. The printer 1 includes: a recording head 3; a carriage 4 to which the recording head 3 is attached; a carriage moving mechanism 5 that moves the carriage 4 along a main scanning direction; a transport mechanism 6 that transports the recording medium 2 along a sub-scanning direction; and the like. It should be noted here that the ink is a kind of liquid of the invention, and the ink is stored in an ink cartridge 7 serving as a liquid supply source. The ink cartridge 7 is detachably attached to the recording head 3. Alternatively, the following configuration may also be employed: the ink cartridge 7 is provided in the main body of the printer 1; and the ink is supplied from the ink cartridge 7 to the recording head 3 through an ink supply tube.

The carriage moving mechanism 5 includes a timing belt 8. The timing belt 8 is driven by a pulse motor 9 such as a DC motor. Therefore, when the pulse motor 9 is activated, the carriage 4 is guided on a guide rod 10 of the printer 1 and moves back and forth along the main scanning direction (that is, along the width of the recording medium 2).

Figure 2:
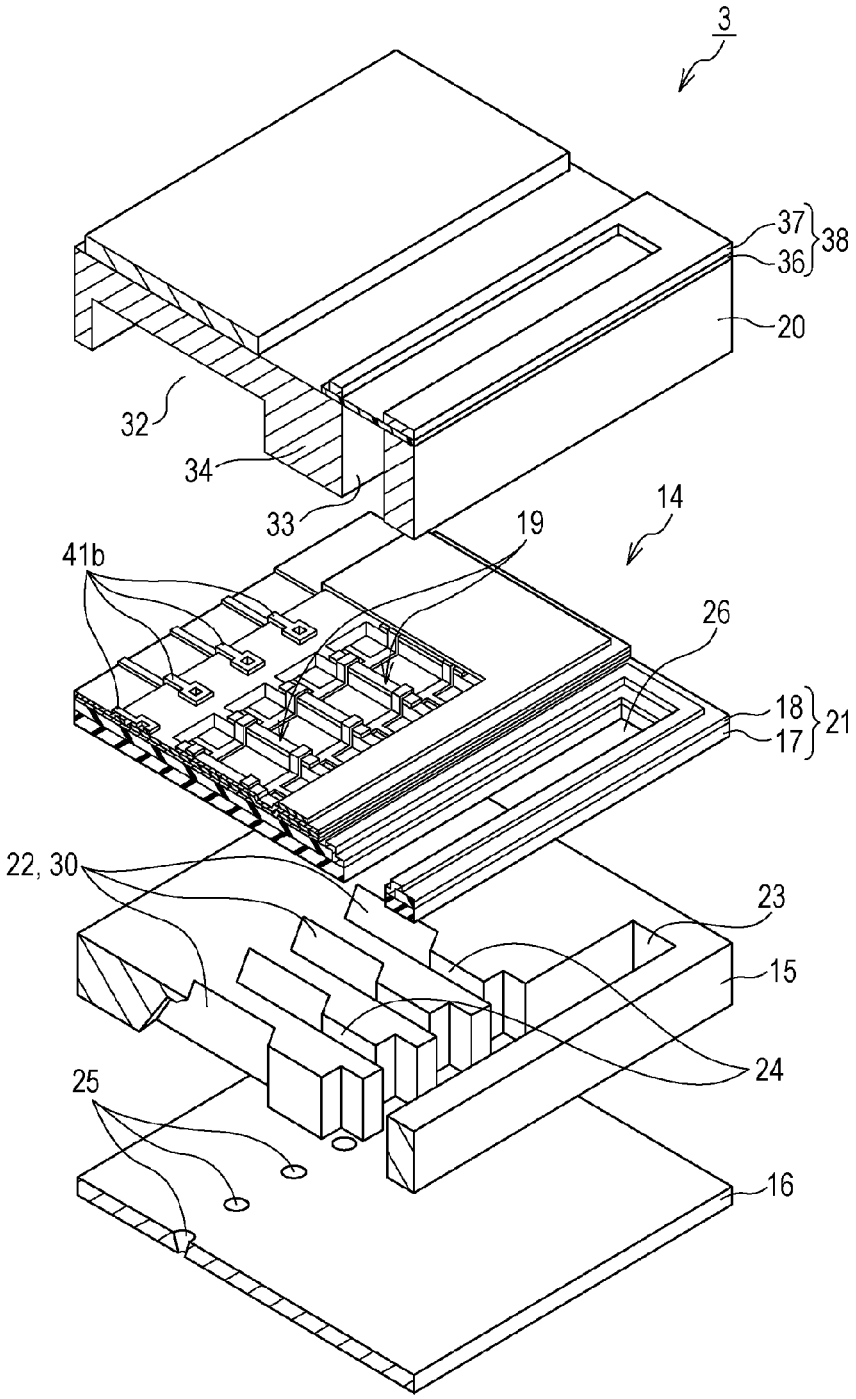
FIG. 2 is an exploded perspective view illustrating a recording head.
Figure 3:
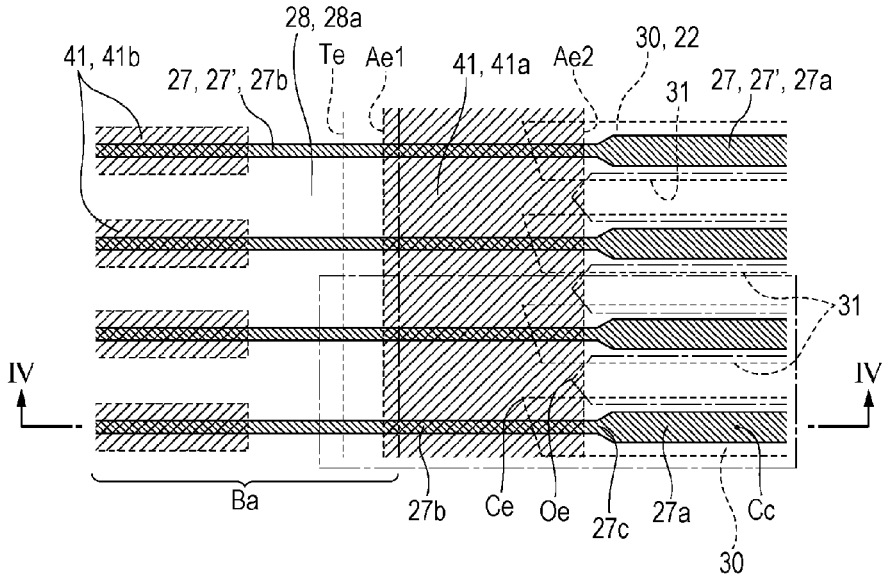
FIG. 3 is a plan view illustrating a configuration of a lower electrode layer, showing a major portion thereof.
Figure 4:
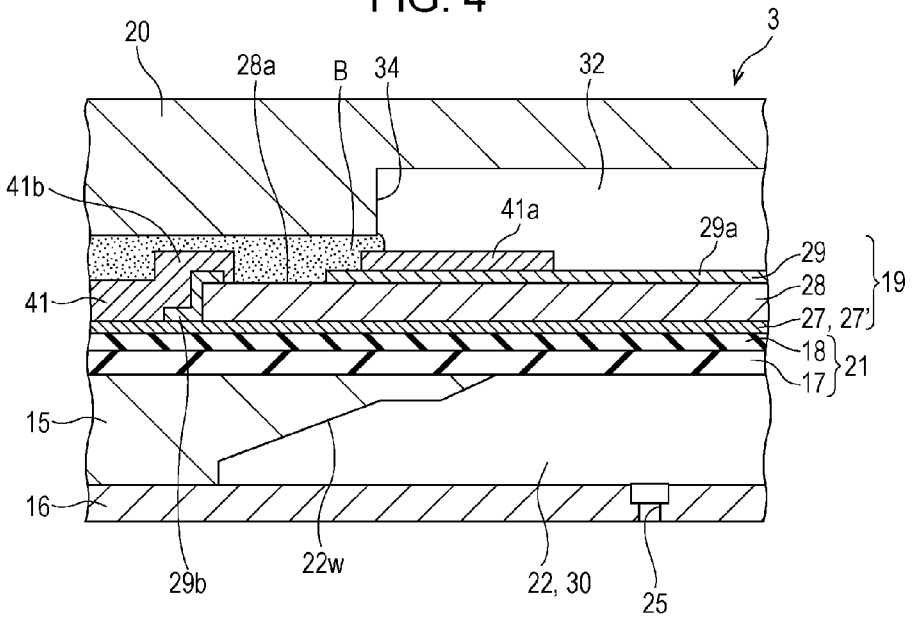
FIG. 4 is a cross-sectional view of the recording head, showing a major portion thereof.
Figure 5:
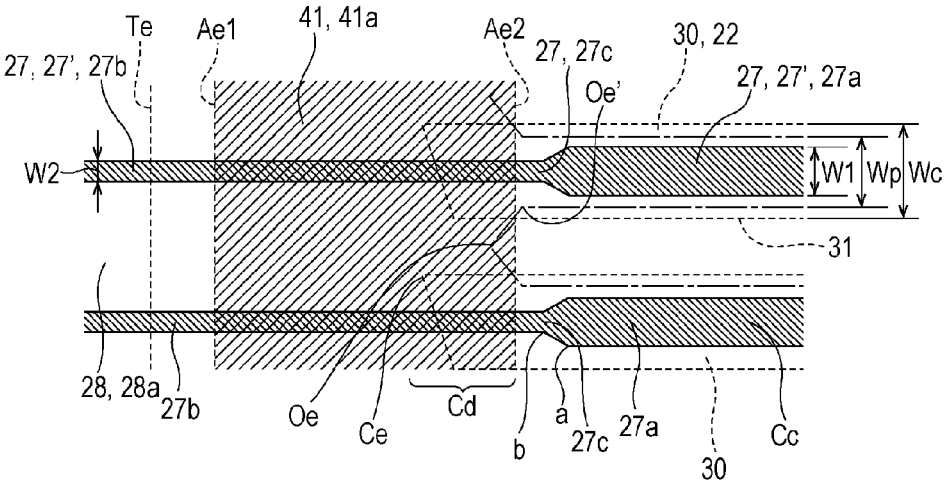
FIG. 5 is an enlarged view of FIG. 3, showing a major portion thereof.

FIG. 2 is an exploded perspective view illustrating a configuration of the recording head 3 of the present embodiment. FIG. 3 is a plan view illustrating a configuration of a lower electrode layer 27 on a vibration plate 21, and FIG. 4 is a cross-sectional view, which is taken along line IV-IV of FIG. 3, of the recording head 3, showing a major portion thereof. FIG. 5 is an enlarged view of the region enclosed by a dot-dash line in FIG. 3. In FIG. 3, regions hatched with dark lines represent the lower electrode layer 27, and regions hatched with light lines represent a metal layer 41. The lower electrode layer 27 and the metal layer 41 will be described later in detail. FIGS. 3 and 4 illustrate a region corresponding to one of opposite ends in the longitudinal direction of each pressure chamber 22 (one of opposite ends in the direction perpendicular to the row of nozzles). That is, FIGS. 3 and 4 illustrate a region corresponding to the ends of the pressure chambers 22 opposite ink supply paths 24. It should be noted that both opposite ends, when seen in the direction of the length of a pressure chamber 22, are hereinafter referred to as "longitudinal ends".

The recording head 3 of the present embodiment is constituted by a stack of: a flow-channel-defining substrate 15 (a kind of pressure-chamber-defining member of the invention); a nozzle plate 16; an actuator unit 14; a sealing plate 20; and the like. In the present embodiment, the flow-channel-defining substrate 15 is constituted by a single-crystal silicon substrate having a (110) plane. The flow-channel-defining substrate 15 has pressure chamber spaces 30 serving as the pressure chambers 22, which are formed by anisotropic etching and which are arranged along the row of nozzles (this direction corresponds to a first direction of the invention). The pressure chambers 22 are spaces defined by: the nozzle plate 16 which closes the bottom openings of the pressure chamber spaces 30 in the flow-channel-defining substrate 15; and the vibration plate 21 which closes the top openings of the pressure chamber spaces 30 in the same manner. The pressure chambers 22 (pressure chamber spaces 30) in the present embodiment are hollow spaces each extending in a direction perpendicular to the row of nozzles and having an opening substantially in the form of a parallelogram.

As illustrated in FIG. 4, each pressure chamber 22 (pressure chamber space 30) in the present embodiment has a wall 22*w* at one longitudinal end. The wall 22*w* is partially sloped with respect to the top and bottom surfaces of the flow-channel-defining substrate 15. Therefore, the inside length of the top opening (the opening closer to a flexible plate, which is described later) of the pressure chamber 22 in the direction of the length of the pressure chamber 22 (this direction corresponds to a second direction of the invention) is shorter than the inside length of the bottom opening in the same direction. The pressure chambers 22 are provided in correspondence with respective nozzles 25 in the nozzle plate 16. That is, the pitch of the pressure chambers 22 corresponds to the pitch of the nozzles 25. The width Wc (inside width, refer to FIG. 5), which is in the direction along which the pressure chambers 22 are arranged, of the top opening of each pressure chamber 22 (pressure chamber space 30) is approximately 70 μm. The total length (inside length of the longest part), which is in the direction of the length of the pressure chamber 22, of the top opening of the pressure chamber 22 is approximately 360 μm.

Furthermore, as illustrated in FIG. 2, there exists a continuous part 23 in a region that is separate from the pressure chambers 22 in the direction of the length of the pressure chambers 22 (in a region opposite the region where the pressure chambers 22 communicate with the nozzles). The continuous part 23 passes through the flow-channel-defining substrate 15 and extends along the direction along which the pressure chambers 22 are arranged. The continuous part 23 is a hollow space that is common to the pressure chambers 22. The continuous part 23 and the pressure chambers 22 are in communication with each other via the ink supply paths 24. The continuous part 23 is in communication with a continuous opening 26 (described later) in the vibration plate 21 and with a liquid chamber space 33 (described later) in the sealing plate 20, thereby forming a reservoir (common liquid chamber) which is an ink chamber common to the pressure chambers 22. The ink supply paths 24 are narrower than the pressure chambers 22, and serve as flow resistances against ink flowing from the continuous part 23 to the pressure chambers 22.

The bottom surface (the surface opposite the vibration plate 21) of the flow-channel-defining substrate 15 is joined to the nozzle plate 16 via an adhesive, a heat fusion film, or the like. The nozzle plate 16 is a plate which has a plurality of nozzles 25 passing therethrough arranged in a row at a predetermined pitch. In the present embodiment, a row of nozzles (a kind of nozzle group) is constituted by 360 nozzles 25 arranged at a pitch corresponding to 360 dpi. The nozzles 25 are in communication with the respective pressure chambers 22 at the ends opposite the ink supply paths 24. The nozzle plate 16 is made from, for example, glass ceramics, single-crystal silicon, stainless steel, or the like.

The actuator unit 14 in the present embodiment includes the vibration plate 21, piezoelectric elements 19, and the metal layer 41. The vibration plate 21 is constituted by: an elastic film 17 made of silicon dioxide ($SiO_2$) provided on top of the flow-channel-defining substrate 15; and an insulation film 18 made of zirconium dioxide ($ZrO_2$) provided on top of the elastic film 17. Regions of the vibration plate 21 that correspond to the pressure chambers 22, that is, the regions that cover the top openings of the pressure chambers 22 (pressure chamber spaces 30), serve as flexible plates (drive parts) that are to undergo a displacement in a direction going away from the nozzles 25 or in a direction approaching the nozzles 25 in response to the deformation of the piezoelectric elements 19. The vibration plate 21 has the continuous opening 26 passing therethrough in a region corresponding to the continuous part 23 in the flow-channel-defining substrate 15. The continuous opening 26 is in communication with the continuous part 23.

The insulation film 18 of the vibration plate 21 has the piezoelectric elements 19 thereon, in the regions corresponding to the pressure chambers 22. The piezoelectric elements 19 in the present embodiment are constituted by the lower electrode layer 27 (corresponding to a first electrode layer of the invention), a piezoelectric layer 28, and an upper electrode layer 29, which are stacked in this order from the vibration plate 21. On the insulation film 18, each of the piezoelectric elements 19 extends (that is, the lower electrode layer 27, the piezoelectric layer 28, and the upper electrode layer 29 each extend) to a position that is separate from the top opening of a corresponding pressure chamber 22 (pressure chamber space 30) in the direction of the length of the pressure chamber 22 (that is, to a position outside a part which serves as a flexible plate in response to the driving of a piezoelectric element 19), beyond the longitudinal end of the top opening of the pressure chamber 22 (that is, beyond the end, at which the pressure chamber 22 is in communication with a corresponding nozzle 25, of the top opening of the pressure chamber 22). The lower electrode layer 27 and the piezoelectric layer 28 further project out of a longitudinal end (the end denoted as Te in FIGS. 3 and 5) of a main part 29*a* of the upper electrode layer 29 and extend to a position that is separate from the end Te of the main part 29*a* of the upper electrode layer 29 in the direction of the length of the pressure chamber 22 (that is, extend to the left side of Te in FIGS. 3 and 5). It should be noted that, also at the ends opposite the above-described longitudinal ends of the top openings of the pressure chambers 22 (pressure chamber spaces 30) illustrated in FIGS. 3 and 4, the piezoelectric elements 19 extend outward beyond the ends of the top openings of the pressure chambers 22 (this is not illustrated in the drawings).

In the present embodiment, the lower electrode layer 27 is patterned and divided into separate lower electrodes 27' (corresponding to separate first electrodes of the invention) corresponding to the respective pressure chambers 22, and the piezoelectric layer 28 is patterned so that the patterned portions of the piezoelectric layer 28 correspond to the respective pressure chambers 22. The lower electrodes 27' are separate electrodes provided for the respective piezoelectric elements 19. Each of the lower electrodes 27' has a plurality of portions that have different widths when seen in the direction along which the pressure chambers 22 are arranged. This will be described later in detail. On the other hand, the upper electrode layer 29 is an electrode common to the piezoelectric elements 19. That is, the upper electrode layer 29 is a continuous electrode extending across the pressure chambers 22 along the direction along which the pressure chambers 22 are arranged. When seen in the thickness direction, a portion in which (i) part of the upper electrode layer 29, (ii) part of the piezoelectric layer 28, and (iii) one of the lower electrodes 27' overlap each other serves as a piezoelectric active part that undergoes a piezoelectric deformation in response to application of voltage to the electrode layers. That is, the upper electrode layer 29 is a common electrode shared by the piezoelectric elements 19, and the lower electrode layer 27 is divided into separate electrodes corresponding to the respective piezoelectric elements 19. It should be noted that the thickness of the lower electrode layer 27 is approximately 150 nm, the thickness of the piezoelectric layer 28 is approximately 1 μm, and the thickness of the upper electrode layer 29 is approximately 70 nm.

A metal layer 41 made of gold (Au) is provided on the upper electrode layer 29 with an adhesion layer (e.g., NiCr, not illustrated) therebetween. The metal layer 41 is constituted by a weight part 41*a* (corresponding to a metallic layer of the invention) and leading electrode parts 41*b*. The weight part 41*a* is provided on the upper electrode layer 29 and, as illustrated in FIG. 5, extends from a position corresponding to the end portion Cd (the portion that includes the longitudinal end, which is denoted as Ce in FIG. 5, of an opening of a pressure chamber 22 and that has a certain length in the direction of the length of the pressure chamber 22) at one longitudinal end of the top opening of the pressure chamber 22 (pressure chamber space 30) to a position short of the longitudinal end Te of the main part 29*a* of the upper electrode layer 29. That is, when seen in the direction of the length of the pressure chamber 22, the weight part 41*a* extends from (i) a position displaced from the longitudinal end Ce of the top opening of the pressure chamber 22 toward the center (denoted as Cc in FIG. 5), when seen in the same direction, of the top opening of the pressure chamber 22 (that is, a position of the top opening of the pressure chamber 22 which corresponds to a flexible plate) to (ii) a position short of one longitudinal end of the upper electrode layer 29 (that is, a position slightly displaced from the end Te of the main part 29*a* of the upper electrode layer 29 toward the center Cc of the top opening of the pressure chamber 22). The length of the weight part 41*a* in the direction of the length of the pressure chamber 22 is approximately 100 μm. Furthermore, the distance from a longitudinal end (denoted as Ae1 in FIG. 5, the end closer to the end Te of the main part 29*a* of the upper electrode layer 29) of the weight part 41*a* to the end Te of the main part 29*a* of the upper electrode layer 29, in the direction of the length of the pressure chamber 22, is approximately 20 μm, and the distance from a longitudinal end (denoted as Ae2 in FIG. 5, the end closer to the center Cc of the top opening of the pressure chamber 22) of the weight part 41*a* to the longitudinal end Ce of the top opening of the pressure chamber 22, in the direction of the length of the pressure chamber 22, is approximately 50 μm. The weight part 41*a* restricts one longitudinal end of each piezoelectric element 19 to thereby prevent excessive displacement of the piezoelectric elements 19 during driving. This reduces the likelihood of the upper electrode layer 29 being detached at the end Te. The leading electrode parts 41*b* are patterned electrode parts corresponding to the respective lower electrodes 27', which are separate electrodes, and are in electrical communication with the respective lower electrodes 27'. Via these leading electrode parts 41*b*, drive voltages (drive pulses) are selectively applied to the piezoelectric elements 19.

The piezoelectric layer 28 in the present embodiment is provided on the vibration plate 21 so as to cover the entirety of the surfaces of the lower electrodes 27'. Examples of the material for the piezoelectric layer 28 include those containing lead (Pb), titanium (Ti), and/or zirconium (Zr). The material may be, for example: a ferroelectric piezoelectric material such as lead zirconate titanate (PZT); a material obtained by adding a metal oxide such as niobium oxide, nickel oxide, or magnesium oxide to a ferroelectric piezoelectric material; or the like. As illustrated in FIG. 3, the piezoelectric layer 28 has holes 31 in areas corresponding to regions between adjacent pressure chambers 22. The holes 31 are recesses or through holes formed by partially removing the piezoelectric layer 28, and extend along the sides of the openings (along edges of the openings) of the pressure chambers 22. In other words, the holes 31 are portions of the piezoelectric layer 28 which have a smaller thickness than the other portion of the piezoelectric layer 28, or holes passing through the piezoelectric layer 28. One longitudinal end of each hole 31 is tapered. That is, the width (inside width), when seen in the direction along which the pressure chambers 22 are arranged, of each hole 31 gradually decreases.

The longitudinal length of each hole 31 is slightly shorter than the longitudinal length of an opening of each pressure chamber 22. In the present embodiment, as illustrated in FIG. 5, a longitudinal end (denoted as Oe in FIG. 5) of the hole 31 is in a position displaced from the longitudinal end Ce of the pressure chamber 22 toward the center Cc, when seen in the direction of the length of the pressure chamber 22, of the top opening of the pressure chamber 22, and overlaps the weight part 41*a* to a small extent. The distance from the longitudinal end Oe of the hole 31 to the end Ae2 of the weight part 41*a* in the direction of the length of the pressure chamber 22 is approximately 20 μm. Furthermore, the distance from a point (denoted as Oe' in FIG. 5) of the tapered longitudinal end of the hole 31, at which the hole 31 starts narrowing, to the end Ae2 of the weight part 41*a* in the same direction is also approximately 20 μm.

The piezoelectric layer 28 has beam-like portions formed therein between adjacent holes 31 above the openings of the pressure chambers 22. The beam-like portions are thicker than portions where there are the holes 31. The beam-like portions of the piezoelectric layer 28 are positioned so as to correspond to the piezoelectric active parts. The width Wp, which is in the direction along which the pressure chambers 22 are arranged, of each of the beam-like parts of the piezoelectric layer 28 is slightly smaller than the width Wc, which is in the same direction, of an opening of a pressure chamber 22. On the other hand, the width Wp of each of the beam-like parts of the piezoelectric layer 28 is slightly larger than the width W1 of a wide portion 27*a* (described later) of a lower electrode 27'. That is, the widths have the relationship W1<Wp<Wc. Since the holes 31 are positioned on opposite sides (in the direction along which the pressure chambers 22 are arranged) of a beam-like portion of the piezoelectric layer 28, it is possible to cause the piezoelectric layer 28 to be smoothly displaced and possible to efficiently impart pressure changes to the ink in the pressure chambers 22.

In the recording head 3 configured like above, the upper electrode layer 29 is partially removed in a region between its main part 29*a* (corresponding to a second electrode layer of the invention) and its conduction part 29*b*, in other words, in a region between the weight part 41*a* and the leading electrode parts 41*b*. In this region, the piezoelectric layer 28 is partially exposed. Such a part of the piezoelectric layer 28 exposed through the upper electrode layer 29 and the metal layer 41 is hereinafter referred to as an exposed part 28*a*.

The actuator unit 14 has, joined on its top surface opposite its bottom surface joined to the flow-channel-defining substrate 15, the sealing plate 20 having a storage space 32 which can store the piezoelectric elements 19. The sealing plate 20 is a member in the form of a hollow box that has the storage space 32 in the bottom surface joined to the actuator unit 14. The storage space 32 is a recess extending vertically from the bottom surface of the sealing plate 20 toward the top surface of the sealing plate 20 to a point short of the height of the sealing plate 20. When seen in the direction of the row of nozzles, the storage space 32 has a size (inner size) that can store all the piezoelectric elements 19 arranged in a row. When seen in a direction perpendicular to the row of nozzles (in the direction of the length of the pressure chambers 22), the storage space 32 is larger than the top openings of the pressure chambers 22 and smaller than the piezoelectric layer 28. Furthermore, as illustrated in FIG. 2, the sealing plate 20 has the liquid chamber space 33 in a position that is separate from the storage space 32 in the direction perpendicular to the row of nozzles, that is, in a region corresponding to the continuous opening 26 in the vibration plate 21 and the continuous part 23 in the flow-channel-defining substrate 15. The liquid chamber space 33 passes through the thickness of the sealing plate 20 and extends along the direction along which the pressure chambers 22 are arranged. As described earlier, the liquid chamber space 33 is in communication with the continuous opening 26 and the continuous part 23, thereby forming a reservoir serving as an ink chamber common to the pressure chambers 22.

The sealing plate 20 has, joined on its top, a compliant substrate 38 constituted by a sealing film 36 and a fixation plate 37. The sealing film 36 is made from a flexible material with small rigidity (e.g., a polyphenylene sulfide film), and seals one opening of the liquid chamber space 33. The fixation plate 37 is made from a hard material such as a metal (e.g., stainless steel or the like). The fixation plate 37 has a through hole in a region which faces the reservoir. Therefore, the above-mentioned one opening of the reservoir is sealed only with the sealing film 36 having flexibility.

It should be noted that, although not illustrated, the sealing plate 20 also has a wire hole passing through its thickness, in addition to the storage space 32 and the liquid chamber space 33. One end of each of the leading electrode parts 41*b* is exposed in the wire hole. The exposed part of each of the leading electrode parts 41*b* is electrically connected to a terminal of a wire (not illustrated) coming from the printer body. The sealing plate 20 further has, for the purpose of controlling the pressure inside the storage space 32 to atmospheric pressure, an air passage through which the storage space 32 communicates with the outside of the sealing plate 20.

The storage space 32 and the liquid chamber space 33 are separated from each other by a partition 34. As illustrated in FIG. 4, the bottom surface of the sealing plate 20, including the bottom edge of the partition 34, is joined to the top surface of the actuator unit 14 with an adhesive B. The adhesive B is made of, for example, an adhesive such as an epoxy adhesive or a urethane adhesive. The adhesive B is applied, by transfer, to the bottom surface of the sealing plate 20 in advance. The sealing plate 20 is joined to the actuator unit 14 in the following manner: the bottom edge of the partition 34 is placed so as to overlap a region denoted as Ba in FIG. 3; and the bottom edge of the partition 34 is joined to this region of the actuator unit 14. More specifically, as illustrated in FIG. 4, the partition 34 is joined to the actuator unit 14 in such a manner that the partition 34 at least extends from (i) the end, which is closer to the leading electrode parts 41*b*, of the weight part 41*a* and one longitudinal end of the main part 29*a* of the upper electrode layer 29 to (ii) the exposed part 28*a* of the piezoelectric layer 28 and the leading electrode parts 41*b*. With this configuration, the one longitudinal end of the main part 29*a* of the upper electrode layer 29 and the exposed part 28*a* of the piezoelectric layer 28 are covered by the adhesive B. In this way, the one end of the main part 29*a* of the upper electrode layer 29 and the exposed part 28*a* of the piezoelectric layer 28 are covered and protected by the adhesive B. This also reduces the likelihood of detachment of the end Te of the main part 29*a* of the upper electrode layer 29.

The following description discusses the lower electrode layer 27. As illustrated in FIG. 5, each of the lower electrodes 27', into which the lower electrode layer 27 is divided, has a plurality of portions that have different widths when seen in the direction along which the pressure chambers 22 are arranged (in the first direction). Specifically, each of the lower electrodes 27' is constituted by (i) a wide portion 27*a* (corresponding to a first portion of the invention) having a width W1 that is smaller than the width Wc of the top opening of a pressure chamber 22 (pressure chamber space 30), (ii) a narrow portion 27*b* (corresponding to a second portion of the invention) having a width W2 that is smaller than the width W1 of the wide portion 27*a*, and (iii) a boundary portion 27*c* that connects the wide portion 27*a* and the narrow portion 27*b* and that is tapered from the wide portion 27*a* to the narrow portion 27*b* (in other words, the width gradually decreases from W1 to W2). The wide portion 27*a* is provided in a region that corresponds to the top opening of the pressure chamber 22 and that includes the center Cc of the top opening of the pressure chamber 22 (within the region that functions as a flexible plate in response to the driving of a piezoelectric element 19). The length, which is in the direction of the length of the pressure chamber 22, of the wide portion 27*a* is shorter than the length, which is in the same direction, of the top opening of the pressure chamber 22. The narrow portion 27*b* is connected to one longitudinal end of the wide portion 27*a* via the boundary portion 27*c* in the direction of the length of the pressure chamber 22 and extends outward to a position that is separate from the top opening of the pressure chamber 22 in the direction of the length of the pressure chamber 22, beyond a longitudinal end of the top opening of the pressure chamber 22.

The boundary portion 27*c* is positioned within a region that corresponds to the top opening of the pressure chamber 22 (within the region of the flexible plate), and is in a position displaced from the longitudinal end Ce of the top opening of the pressure chamber 22 toward the center Cc of the top opening of the pressure chamber 22. Furthermore, the boundary portion 27*c* is in a position displaced from the end Ae2 (the end closer to the end portion Cd of the top opening of the pressure chamber 22) of the weight part 41*a* toward the center Cc of the top opening of the pressure chamber 22. In other words, the end "a", which is closer to the boundary portion 27*c* (closer to the narrow portion 27*b*), of the wide portion 27*a* and the end "b", which is closer to the boundary portion 27*c* (closer to the wide portion 27*a*), of the narrow portion 27*b* are positioned within a region that corresponds to the top opening of the pressure chamber (within the region of the flexible plate). That is, each of the lower electrodes 27' narrows within a region that corresponds to the top opening of the pressure chamber 22 (within the region of the flexible plate) and, while keeping the narrow width, extends to outside of the pressure chamber 22 beyond one longitudinal end of the top opening of the pressure chamber 22.

Figure 6:
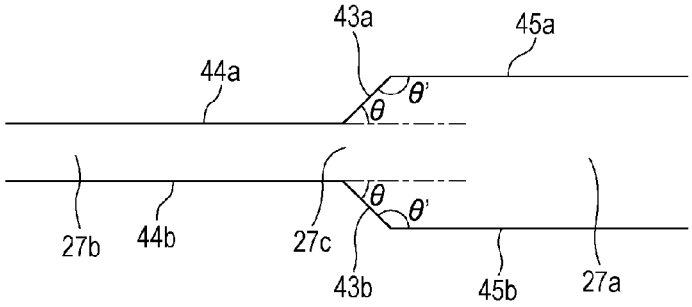
FIG. 6 is an enlarged view illustrating a boundary portion of a lower electrode and its surroundings, showing a major portion of the boundary portion.

FIG. 6 is an enlarged view illustrating the boundary portion 27*c* and its surroundings, showing a major portion of the boundary portion 27*c*. Side edges 43*a* and 43*b* of the boundary portion 27*c* are inclined with respect to the direction in which the wide portion 27*a* and the narrow portion 27*b* extend (that is, in the horizontal direction of FIG. 6). The angle of inclination θ, that is, the angle θ between a line (dot-dash line in FIG. 6, extending toward the wide portion 27*a*) extending from a side edge 44*a* of the narrow portion 27*b* and the side edge 43*a* of the boundary portion 27*c* and the angle θ between a line extending from a side edge 44*b* of the narrow portion 27*b* and the side edge 43*b* of the boundary portion 27*c*, each may be any angle within the range of not less than 30° and not more than 60°, more preferably 45°. In other words, the angle θ' between a side edge 45*a* of the wide portion 27*a* and the side edge 43*a* of the boundary portion 27*c* and the angle θ' between a side edge 45*b* of the wide portion 27*a* and the side edge 43*b* of the boundary portion 27*c* each may be any angle within the range of not less than 120° and not more than 150°, more preferably 135°.

The width W2 of the narrow portion 27*b* in a region that corresponds to the outside of the top opening of the pressure chamber 22 (pressure chamber space 30) in the direction of the length of the pressure chamber 22 is not less than 20% and not more than 55% of the width W1 of the wide portion 27*a*. Specifically, for example, the width W1 of the wide portion 27*a* is approximately 42 μm, whereas the width W2 of the narrow portion 27*b* is approximately 15 μm (approximately 36% of W1). That is, the width W2 of the narrow portion 27*b* is not less than 8 μm and not more than 23 μm. The length (in the direction of the length of the pressure chamber 22) of the boundary portion 27*c* (the length from the position "a", at which the width of the lower electrode 27' starts decreasing from W1, to the position "b", at which the width is W2) is approximately 30 μm. Furthermore, the distance (in the direction of the length of the pressure chamber 22) from the point Oe', at which the tapered longitudinal end of a hole 31 in the piezoelectric layer 28 starts narrowing, to the end "b", which is closer to the wide portion 27*a* (closer to the boundary portion 27*c*), of the narrow portion 27*b* is 15 μm.

In the above-described configuration, the width W2 of a portion (narrow portion 27*b*) of each lower electrode 27' which extends to outside of the top opening of a pressure chamber 22 (pressure chamber space 30) in the direction of the length of the pressure chamber 22 is smaller than the width W1 of a portion (wide portion 27*a*) of the lower electrode 27' which is positioned within a region corresponding to the top opening of the pressure chamber 22 (within the region of a flexible plate). With this configuration, the area of a part that serves as an active part outside the top opening of the pressure chamber 22 (pressure chamber space 30) is reduced. That is, it is possible to reduce the area of a part at risk of damage from stress when the piezoelectric elements 19 are driven. Furthermore, since the area of the active part is reduced, it is also possible to reduce the stress that may occur in this part. As a result, it is possible to reduce burn damage and breakage caused by cracking of the active part outside the region of the top opening of the pressure chamber 22. In particular, the present embodiment employs a configuration in which: the adhesive B is provided for the purpose of protecting the piezoelectric layer 28 extending to outside of the top opening of the pressure chamber 22; and the adhesive B restricts the movement of the active part outside the top opening of the pressure chamber 22. Therefore, it is possible to reduce the degree of deformation of the active part and to reduce stress concentration. This reduces the likelihood of burn damage occurring in the active part outside the top opening of the pressure chamber 22. It should be noted that, since the adhesive B also covers and protects an end (end portion that includes the end Te and that has a certain length in the direction of the length of the pressure chamber 22) of the main part 29*a* of the upper electrode layer 29, the likelihood of detachment of the main part 29*a* of the upper electrode layer 29 is reduced.

Furthermore, since the width W2 of the narrow portion 27*b* is not less than 20% and not more than 55% of the width W1 of the wide portion 27*a*, the width of the narrow portion 27*b* is not excessively narrow and therefore a reduction in electric conductivity is prevented and, at the same time, stress concentration on the active part outside the top opening of the pressure chamber 22 is reduced. This more significantly reduces the probability that the active part decreases in electric conductivity and suffers burn damage. Here, an evaluation experiment was performed on a plurality of piezoelectric elements 19 in which their narrow portions 27*b* had different widths W2. As a result, the following was revealed. In the case where W2 is too narrow (that is, in the case where W2 is less than 20% of W1), the electric conductivity of the narrow portion 27*b* decreases and thus the properties of the piezoelectric element 19 become worse. On the other hand, in the case where W2 is too wide (that is, in the case where W2 is more than 55% of W1), the area of an active part whose movement is restricted increases and also stress increases, and therefore the active part becomes more prone to breakage. As a result, when the piezoelectric element 19 is driven, stress concentration occurs and thus deterioration accelerates in the active part (in particular, in the lower electrode layer 27) outside the top opening of the pressure chamber 22. As a result, the electric conductivity decreases instead of increasing.

Furthermore, in the present embodiment, stress is likely to concentrate on or near a boundary between a region where there is a hole 31 in the piezoelectric layer 28 and a region where there is no hole 31 in the piezoelectric layer 28 (in particular, on or near the longitudinal end Oe of the hole 31). Therefore, since the boundary portion 27*c* is in a position displaced from this boundary toward the center Cc of the top opening of the pressure chamber 22, it is possible to reduce the stress on the boundary and thus possible to reduce stress concentration. Furthermore, in the present embodiment, since the weight part 41*a* is provided, it is possible to restrict the movement of this region of the active part. In addition, since the boundary portion 27*c* is in a position displaced from the end Ae2 of the weight part 41*a* toward the center Cc of the top opening of the pressure chamber 22, the width of the lower electrode 27' decreases within a region displaced from the part prone to stress concentration toward the center Cc of the top opening of the pressure chamber 22. This makes it possible to more significantly suppress the boundary portion 27*c* from markedly changing and thus possible to further reduce stress concentration.

It should be noted that, as for the width of each lower electrode 27', a configuration in which the width of the lower electrode 27' changes in steps from the center of the opening of the pressure chamber 22 toward the outside of the top opening of the pressure chamber 22 may be employed. That is, the width of the lower electrode 27' may have any configuration, provided that the width is relatively wide in a portion closer to the center of the top opening of the pressure chamber 22 (closer to a flexible plate) (that is, a portion having a fixed width extends along the opposite sides, in the direction along which the pressure chambers 22 are arranged, of the top opening of the pressure chamber 22) and is narrow in a portion that extends to outside of the top opening of the pressure chamber 22 in the direction of the length of the pressure chamber 22. Furthermore, as for a configuration in which the width of each lower electrode 27' changes in a region that is separate from the top opening of the pressure chamber 22 in the direction of the length of the pressure chamber 22, any configuration may be employed provided that the average width in this region is smaller (narrower) than the width in a region closer to the center of the top opening of the pressure chamber 22 (closer to a flexible plate).

The invention is not limited to the embodiments described above. Furthermore, although the above-described embodiments employ as an example an ink jet recording head to be included in an ink jet printer, the invention is also applicable to a head from which a liquid other than ink is ejected, provided that a piezoelectric element configured like above is used. For example, the invention is also applicable to a color material ejecting head for use in production of color filters for liquid crystal displays or the like, an electrode material ejecting head for use in formation of electrodes for organic EL (electro luminescence) displays, FEDs (field emission displays) or the like, and a living organic substance ejecting head for use in production of biochips, and the like.

What is claimed is:

1. A liquid ejecting head, comprising:

a pressure-chamber-defining member having a plurality of pressure chamber spaces that are arranged along a first direction, the pressure chamber spaces serving as pressure chambers in communication with nozzles; and a piezoelectric element having a first electrode layer, a piezoelectric layer, and a second electrode layer that are stacked in this order from a flexible plate on one side of the pressure-chamber-defining member and positioned above the pressure chamber spaces, the first electrode layer being divided into separate first electrodes corresponding to the respective pressure chamber spaces, and the second electrode layer being a continuous electrode extending along the first direction across the pressure chamber spaces, each of the separate first electrodes having a first portion and a second portion, the first portion being narrower than a corresponding one of the pressure chamber spaces when seen in the first direction, and the second portion being narrower than the first portion when seen in the first direction, the first portion being positioned in a region that corresponds to an opening of the corresponding one of the pressure chamber spaces and that includes a center of the opening of the corresponding one of the pressure chamber spaces, the center being a center of the opening of the corresponding one of the pressure chamber spaces when seen in a second direction intersecting the first direction, and the second portion continuously extending from the first portion to a region that corresponds to outside of the opening of the corresponding one of the pressure chamber spaces in the second direction, wherein:

the piezoelectric layer has holes in regions between the pressure chamber spaces adjacent to each other along the first direction; and a boundary portion of each of the separate first electrodes, the boundary portion being a portion between the first portion and the second portion, is in a position displaced from (i) one of opposite ends in the second direction of a corresponding one of the holes in the piezoelectric layer toward (ii) the center of the opening of the corresponding one of the pressure chamber spaces.

2. The liquid ejecting head according to claim 1, wherein:

in the region that corresponds to outside of the opening of the corresponding one of the pressure chamber spaces in the second direction, the second portion of each of the separate first electrodes and the piezoelectric layer project outwards, in the second direction, from one of opposite ends in the second direction of the second electrode layer; and the one of the opposite ends of the second electrode layer and a projecting part of the piezoelectric layer, the projecting part overlapping the second portion, are covered with an adhesive layer.

3. The liquid ejecting head according to claim 2, wherein a width of the second portion of each of the separate first electrodes, in the region that corresponds to outside of the opening of the corresponding one of the pressure chamber spaces in the second direction, is not less than 20% and not more than 55% of a width of the first portion.

4. A liquid ejecting apparatus comprising the liquid ejecting head according to claim 3.

5. A liquid ejecting apparatus comprising the liquid ejecting head according to claim 2.

6. The liquid ejecting head according to claim 1, further comprising a metallic layer provided on the second electrode layer so as to cover a region extending from (i) a position corresponding to one of opposite end portions in the second direction of the opening of the corresponding one of the pressure chamber spaces to (ii) a position short of the one of the opposite ends in the second direction of the second electrode layer, the boundary portion between the first portion and the second portion being in a position between (i) the one of the opposite end of the metallic layer in the second direction, which is closer to the one of the opposite end portions of the opening of the corresponding one of the pressure chamber spaces and (ii) the center of the opening of the corresponding one of the pressure chamber spaces.

7. A liquid ejecting apparatus comprising the liquid ejecting head according to claim 6.

8. A liquid ejecting apparatus comprising the liquid ejecting head according to claim 1.

* * * * *